US005823034A

United States Patent [19]

Nelepovitz

[11] Patent Number: 5,823,034

[45] Date of Patent: Oct. 20, 1998

[54] SUPERPLASTIC METALFORMING WITH SELF-CONTAINED DIE

[75] Inventor: Donald O. Nelepovitz, San Diego, Calif.

[73] Assignee: Hyperform Technologies, Inc., San Diego, Calif.

[21] Appl. No.: 948,678

[22] Filed: Oct. 10, 1997

[51] Int. Cl.[6] ..... B21D 26/02

[52] U.S. Cl. ..... 72/60; 72/61; 72/709

[58] Field of Search ..... 72/54, 56, 60, 72/61, 62, 709

[56] References Cited

U.S. PATENT DOCUMENTS

| | | | |
|---|---|---|---|
| 3,249,989 | 5/1966 | Robinson | 72/62 |
| 4,029,254 | 6/1977 | Blair et al. | 228/181 |
| 4,319,471 | 3/1982 | Benteler et al. | 72/62 |
| 4,392,602 | 7/1983 | Darby | 282/118 |
| 4,584,860 | 4/1986 | Leonard | 72/61 |
| 4,889,276 | 12/1989 | Cadwell et al. | 228/265 |
| 4,988,037 | 1/1991 | Cadwell | 228/265 |
| 5,002,219 | 3/1991 | Cadwell | 228/155 |
| 5,419,171 | 5/1995 | Bumgarner | 72/62 |
| 5,419,791 | 5/1995 | Folmer | 72/60 |
| 5,553,474 | 9/1996 | Nokajima et al. | 72/60 |
| 5,649,439 | 7/1997 | Schulz | 72/62 |

FOREIGN PATENT DOCUMENTS

| | | | |
|---|---|---|---|
| 2224965 | 5/1990 | Japan | 72/61 |

*Primary Examiner*—David Jones
*Attorney, Agent, or Firm*—Brown, Martin, Haller & McClain

[57] ABSTRACT

A superplastic forming (SPF) method using a self-contained die obviates the need for external containment bands or rings. The method and die are particularly advantageous for use in forming generally planar parts but may also be used to form parts of a more cylindrical shape. The die includes two or more die segments, each of which is unitarily formed from a suitable material such as graphite or ceramic. Each die segment has a unitarily formed connecting portion for interlocking it to another die segment. The connection portion may be a tab having a bore through which a pin may be extended to interlock the die segments. The die may swing open and closed in a hinged manner or be completely separable. In accordance with the method, a gas-tight preform assembly made of a metal such as titanium alloy is placed in the die. The die and preform assembly are heated in a vacuum furnace. Gas is injected into the preform assembly, expanding it to conform to the shape of the interior of the die. Upon cooling, the assembly is removed and trimmed to separate the finished part.

22 Claims, 4 Drawing Sheets

SUPERPLASTIC METALFORMING WITH SELF-CONTAINED DIE

BACKGROUND OF THE INVENTION

1. Field of the Invention

The present invention relates generally to systems and methods for superplastic forming of metal parts for aerospace and similar uses. More specifically, the present invention relates to a superplastic forming die having interlocking segments that obviate the need for external containment rings.

2. Description of the Related Art

Certain metals, such as titanium alloys, exhibit superplasticity at high temperatures. Superplasticity is characterized by the ability of these metals to exhibit tensile elongation far in excess of what other metals can exhibit without exhibiting local necking. Superplastic forming (SPF) methods have primarily been used to form various planar, complex contoured, as well as cylindrical titanium alloy aerospace parts, such as engine intakes, nozzles, combustion chambers and cowlings.

A well-known superplastic metalforming method includes the following steps. First, two titanium sheets are rolled and welded to form two cylinders, a "forming cylinder" and a "slave cylinder," of the same length but slightly different diameters. The forming and slave cylinders are placed concentrically, with the slave cylinder inside the forming cylinder. The upper ends of the forming and slave cylinders are then welded together, as are their lower ends. One or more gas fittings are welded in place along the upper or lower weld beads. The resulting assembly, known as a preform assembly, thus has a tubular chamber bounded by the inner wall of the forming cylinder, the outer wall of the slave cylinder, and the upper and lower weld beads. The welds seal the chamber gas-tight but for the gas fittings. The preform assembly is then placed over a mandrel, which typically consists of a sturdy steel cylinder having an outside diameter slightly less than the inside diameter of the preform assembly. A multipiece generally cylindrical graphite die is placed around the preform assembly. The die consists of several sector-shaped segments to allow it to be removed following forming, as described below. Graphite is the preferred material because it has an extremely low coefficient of thermal expansion and can readily be machined. Nevertheless, cast ceramic dies are also known. One or more containment bands made of graphite are then placed over the die. It is known that using multiple containment rings spaced from one another rather than a single longer, cylindrical containment band is advantageous because the spaced, less massive rings heat more quickly during the heating step and cools more quickly during the cool-down step of the process. The entire assembly is then placed in a vacuum furnace and heated to a temperature at which the titanium exhibits superplasticity. Inert gas, such as argon, is introduced under pressure into the gas fittings. The gas pressure presses the slave sheet firmly against the mandrel and the forming sheet firmly against the inner surface of the die. The inner surface of the die reflects the desired shape of the part to be formed. The forming sheet thus conforms to the shape of the inner surface of the die. The gas pressure is then relieved and the assembly cooled. When the assembly has cooled, the containment rings and die segments are removed. The upper and lower edges of the formed metal assembly are trimmed to separate the portion that includes the formed part from the remaining portion, which formerly defined the slave sheet, portions of the welds, the gas fittings, handling tabs, and so forth. The formed part may then be further trimmed and finished in any suitable manner.

Another very common SPF method has been used for forming parts that are more planar and less cylindrical, The method is similar to the simple stamping methods that have long been used to form sheet metal parts. A generally flat or planar steel die half having a generally concave surface that reflects the shape of the part to be formed is placed horizontally in a "hot box" (a frame having a heating element), with the concave surface of the die facing upwardly. A titanium sheet is placed on top of this lower die half. The hot box then heats the titanium sheet to a temperature at which it will exhibit superplasticity. The upper portion of the press clamps down on the sheet/die combination and is brought up to SPF temperature. Gas pressure is applied to the sheet, causing it to form into the die. After forming is complete, the press top is raised and the sheet is removed, followed by immediate insertion of a new sheet, and a repeat of the forming cycle.

It would be desirable to provide an improved SPF method and apparatus that enable generally planar parts as well as parts of a more cylindrical shape to be formed without requiring the expensive press apparatus as well as more economical tooling. These needs are clearly felt in the art and are satisfied by the present invention in the manner described below.

SUMMARY OF THE INVENTION

The present invention relates to a superplastic forming (SPF) method and to a self-contained die apparatus that does not require external containment bands or rings. The method and die are particularly advantageous for use in forming generally planar parts but may also be used to form parts of a more cylindrical shape.

The die includes two or more die segments, each of which is unitarily formed from a suitable material such as graphite or ceramic. Each die segment has a unitarily formed connecting portion for interlocking it to another die segment. In an exemplary embodiment of the invention, the connecting portion is a tab having a bore. Pins are included that may be extended through the aligned bores of two or more die segments to interlock them. In other embodiments, the connecting portions may interlock directly to one another without pins or other external connecting elements. When interlocked in this manner, the interior chamber of the die defines the shape of the part to be formed.

The interlocking of unitarily formed die segments obviates the need for external containment rings. It has been discovered in accordance with the present invention that graphite and ceramic materials are generally sufficiently strong to withstand the SPF process without external reinforcement. Moreover, such materials are preferred because they can readily be machined or cast to provide the interior chamber of the die with the desired shape. Other materials having equivalent strength and resistance to thermal expansion and that may be machined, cast or otherwise readily shaped may also be suitable. The absence of massive containment rings, which undesirably act as heat sinks in prior die assemblies, allows the die to heat rapidly during the heating step of the SPF process and cool rapidly during the cooling step. Furthermore, the absence of heavy containment rings facilitates handling of the die apparatus.

In certain embodiments of the invention, the die may swing open and closed on hinges. In such a hinged embodiment, the portions of the die that swing relative to one another each preferably comprise a single die segment, but multiple die segments would also be suitable. The die segments may include tabs, as described above. One or more pins extending through bores at one end of the die may define the hinges. Similarly, one or more pins may be extended through the bores at an opposite end of the die to removably interlock the die segments after swinging the die closed. Thus, the tabs and pins may hingedly interlock the two die portions at one end, and removably interlock the two die portions at an opposite other end.

The die may have any suitable shape, although the shape of the die may reflect the shape of the part to be formed in it. For example, to form a generally planar part, such as a body panel, the die may be generally planar. Similarly, to form a more cylindrical part, such as an exhaust nozzle, the die may be generally cylindrical. Nevertheless, the part may be formed inside the die in any suitable orientation and thus does not dictate the shape of the die.

To use the die in the SPF method, a gas-tight preform is assembled or otherwise provided and then placed inside the die. The preform assembly reflects a generalized shape of the part to be formed, and may be cylindrical for forming generally cylindrical parts or planar for forming generally planar parts. In embodiments in which the method uses a hinged die, a die portion may be lifted or swung open before disposing the preform inside. The die is closed by interlocking one or more connecting portions of the die segments. In embodiments in which the method uses a hinged die, a die portion may be lowered and assembled or swung closed before interlocking the die segments. In embodiments in which the connecting portions of the die segments include bores, a pin is extended through the bores of aligned die segments to interlock them. The die with the preform assembly inside it is then placed into a vacuum furnace and heated. Inert gas is introduced under pressure into the preform assembly, superplastically expanding it and forcing it to conform to the shape of the interior chamber of the die. The gas pressure is then relieved and the assembly cooled. When the assembly has cooled, the die segments are separated. In embodiments in which the method uses a hinged die, the die is swung open. The expanded assembly is then removed from the die and trimmed to separate the portion that includes the formed part from the remaining portion.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein.

DESCRIPTION OF PREFERRED EMBODIMENTS

Figure 1:
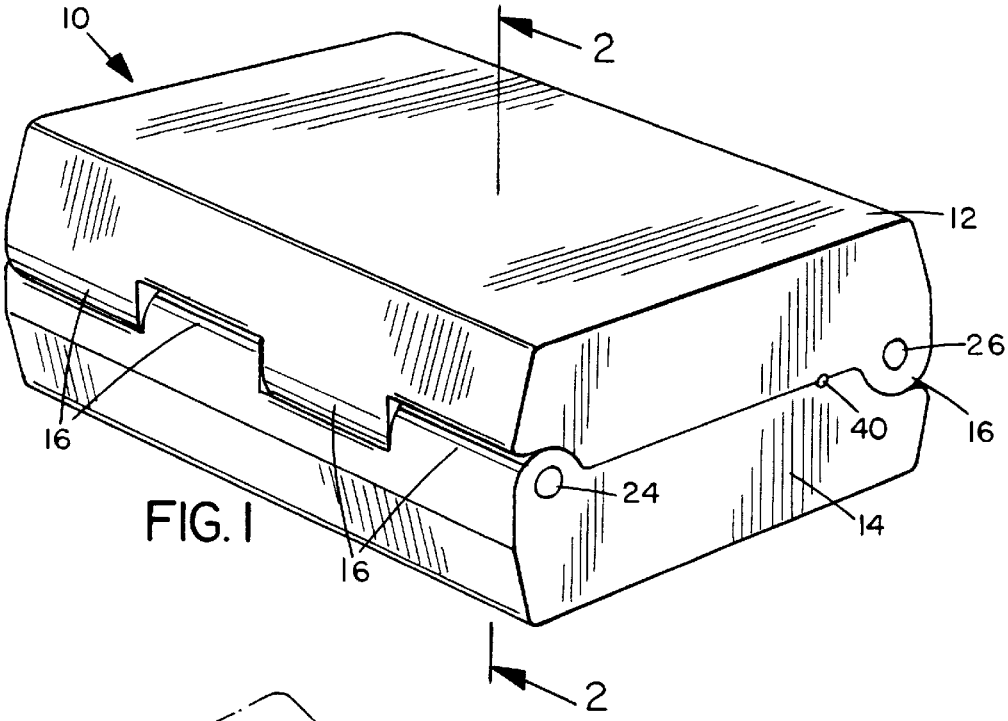
FIG. 1 is a perspective view of an embodiment of a forming die apparatus.
Figure 2:
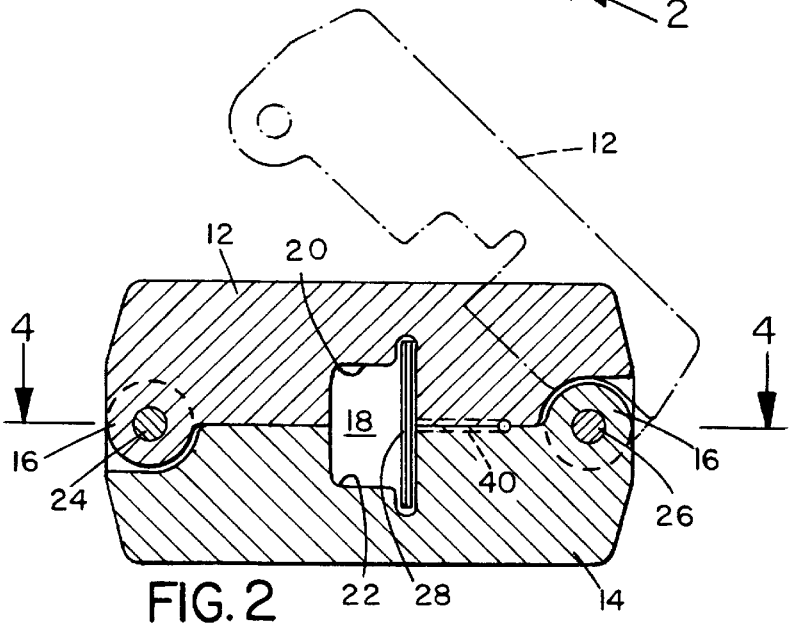
FIG. 2 is a sectional view taken on line 2—2 of FIG. 1.

In the exemplary embodiment illustrated in FIGS. 1, 2, 4, 12 and 13, a die 10 has a generally planar shape that is particularly suitable for superplastic forming (SPF) of generally planar parts. Die 10 includes two die segments 12 and 14 that are movable relative to one another in a hinged manner. Each of die segments 12 and 14 has connecting portions 16 unitarily formed in them. Although connecting portions 16 are tabs interleaved in a hinge-like manner in this embodiment, in other embodiments they may be arranged in any suitable manner relative to one another. Furthermore, although each of the two halves or portions of die 10 capable of relative movement consists of a single die segment, each may alternatively consist of a group of one or more die segments.

Die segments 12 and 14 are made of a material suitable for use in a vacuum furnace, that resists thermal expansion, and that can easily be machined, cast or otherwise formed. Graphite and ceramic materials are particularly advantageous and are the two predominant materials used in prior SPF dies because they have these qualities. For example, to form die 10, two blocks of graphite may be machined to produce connecting portions 16 and a suitable interior forming chamber. As illustrated, an interior chamber 18 has surfaces 20 and 22 reflecting the shape of the part to be formed therein. The shape of the illustrated interior chamber 18 is merely exemplary; it may have any suitable shape. For instance, In FIGS. 2 and 4 the chamber 18 is aligned vertically for the shaping of preform assembly 28 in a vertical orientation, while in FIGS. 12 and 13 the chamber 18 is aligned horizontally, for the shaping of preform assembly 28' resting on shelf 27 in a horizontal orientation. It is anticipated that the latter horizontal orientation will be the most commonly used in commercial manufacturing operations.

Because die 10 is itself generally flat or planar, it is particularly well-suited for forming generally planar parts. Furthermore, although in this exemplary die 10, the shape of the part to be formed is defined by the combined effect of surfaces 20 and 22 distributed between the two die segments 12 and 14, in other embodiments the surface or surfaces reflecting the shape of the part to be formed may be included within a single die segment or distributed among more than two die segments.

Connecting portions 16 of die segment 12 are interlockable with those of die segment 14. Two pins 24 and 26 extend through bores in connecting portions 16 to interlock die segments 12 and 14. Although in this exemplary embodiment the engagement of pins 24 and 26 with the bores of die segments 12 and 14 functions to interlock die segments 12 and 14, in other embodiments the connecting portions may interlock directly with one another without the use of pins or other external connectors.

The interlocking of unitarily formed die segments with one another is a very important aspect of the invention because it obviates the need for external containment rings, as were used in the prior art. Regardless of whether made of graphite, ceramic or other material, the walls of die segments 12 and 14 can be made sufficiently thick to enable them to withstand the SPF process described below without external reinforcement. Such materials are relatively economical, and there is little need to economize on die thickness.

Pins 24 and 26 are preferably sized relative to the bores through which they extend to enable the following feature, which may be included in certain embodiments of the invention. In accordance with this feature, each of pins 24 and 26 has a diameter less than the diameter of the bores through which it extends when the pins and the die segments are at a low temperature but expands to a diameter equal to the bore diameter at the higher temperatures of the SPF process. Thus, at room temperature or a similarly low temperature at which the die apparatus can be handled, a user may readily insert or remove pins 24 and 26. But when the die apparatus is heated in a vacuum furnace as described below, the pins expand in the bores, thereby lodging themselves in the bores and more securely holding die segments 12 and 14 together. Although the precise temperature at which pins 24 and 26 lodge themselves in the bores is not critical to the invention, for the sake of clarity, pins 24 and 26 may be movable in the bores when the temperature is, for example, less than about 100° (212° F.) and may become immovable in the bores when the temperature is greater than about 500° C. (932° F.). This operation may readily be achieved in a die apparatus in which die segments 12 and 14 are made of graphite or ceramic and pins 24 and 26 are made of steel, Inconel or similar alloys because such metals have much greater coefficients of thermal expansion than graphite and ceramic. In general terms, pins 24 and 26 are made of a material having a higher coefficient of thermal expansion than the material from which die segments 12 and 14 are made.

Figure 14:
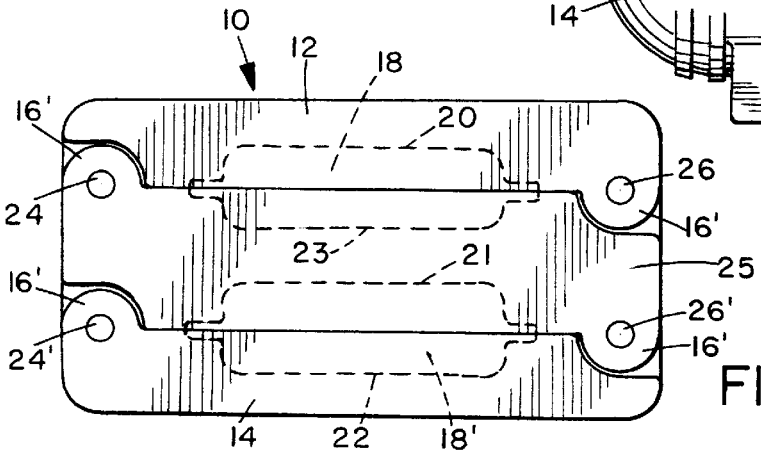
FIG. 14 is a side elevation view of yet another embodiment of the invention, illustrating a multiply mold configuration.

As illustrated in FIG. 14, the die 10 of the present invention can be assembled in "multi-stack" configurations, in which a plurality of parts can be formed simultaneously. FIG. 14 illustrates a "two-stack" die in which die segments 12 and 14 serve respectively as the top and bottom of the "stack," and have die segment 25 disposed between them. Die segment 25 has connecting portions 16' on its top and bottom sides, to interfit with connecting portions 16 of die segments 12 and 14 in the same manner as described above the "single stack" version of FIG. 2. Each opposite major face of segment 25 has a surface 21 or 23 respectively formed in it, so that surfaces 20 and 21 of respectively segments 12 and 25 form chamber 18 and surfaces 22 and 23 of respectively segments 14 and 25 form chamber 18'. Of course segment 25 may be repeated as needed, to form stacks of various numbers of chambers 18, 18', etc. All of the chambers 18, 18', etc. may be identically configured so that multiple copies of the same products are made at the same time, or some or all of the chambers 18, 18', etc. may be different from the others, so that a plurality of different products can be made simultaneously. Pins 24 and 26 lock segments 12 and 25 together, while pins 24' and 26' lock segments 25 and 14 together, and such would of course be repeated as needed depending on the number of segments 25 in a particular configuration.

Figure 3:
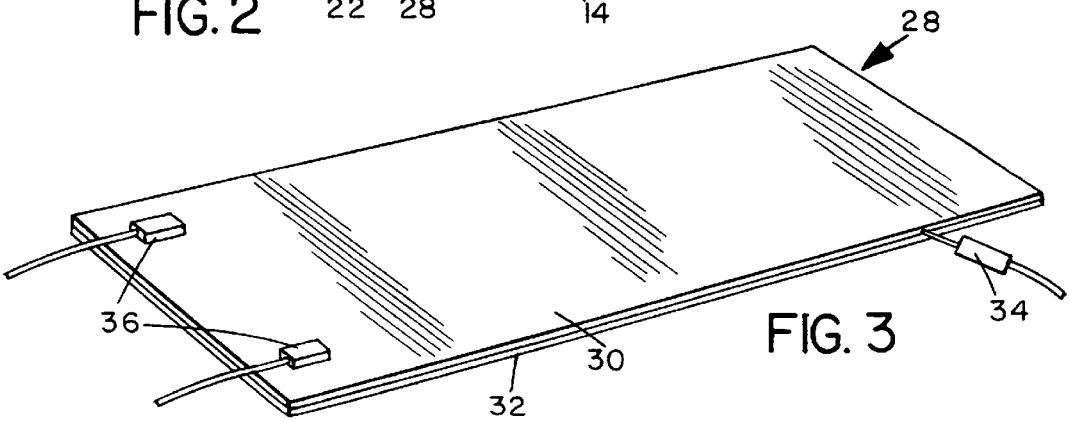
FIG. 3 is a perspective view of a planar preform assembly to be formed in the die.
Figure 4:
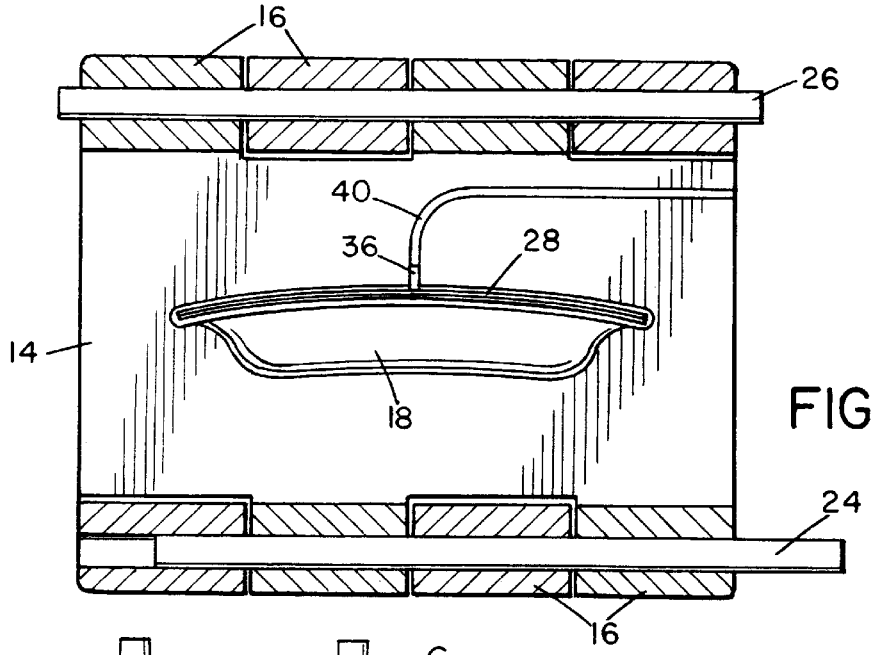
FIG. 4 is a sectional view taken on line 4—4 of FIG. 2.
Figure 5:
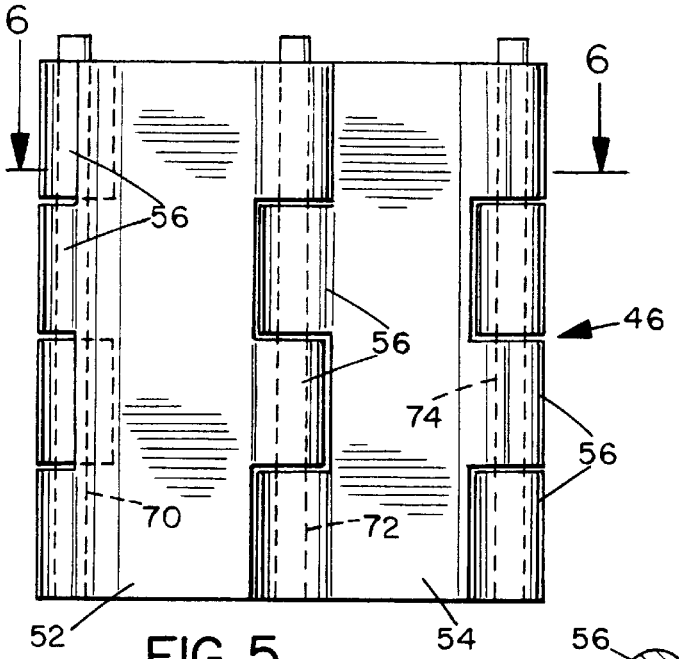
FIG. 5 is a side view of an alternative embodiment of a forming die.

As illustrated in FIG. 3, a preform assembly 28 suitable for use in a SPF process in conjunction with die 10 is formed by welding two appropriately shaped metal sheets 30 and 32 to one another to form a continuous weld bead along their peripheries, as indicated by the use of welding tool 34. Sheets 30 and 32 are made of a suitable metal that exhibits superplasticity, such as Ti-6A1-4V. One or more suitable gas fittings 36 are welded over bores in one of the sheets. Preform assembly 28 is thus made gas-tight but for fittings 36. Prior to welding them together, the sheets may be cut, rolled or bent to better conform to the contours of the die chamber into which it is to be placed. If desired, one may also roll the illustrated sheets 30 and 32 to impart a slight curvature that corresponds to the curvature of chamber 18 of die 10. (As noted above, the curvature and other features of the shape of the illustrated chamber 18 are intended merely to be exemplary.)

To open die 10, one or both of pins 22 and 24 must be removed. By removing only one of pins 22 and 24, die 10 can be swung open in a convenient clamshell-like manner because the remaining pin functions as a hinge pin. Die 10 is opened as shown in phantom line in FIG. 2, and preform assembly 28 is placed into chamber 18. Die 10 is then closed and the pin or pins replaced.

Figure 10:
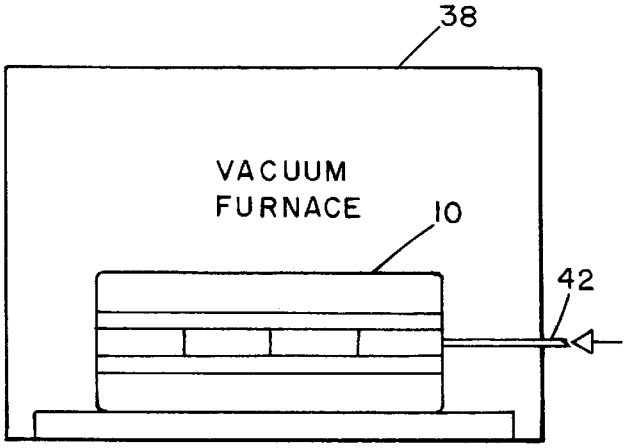
FIG. 10 illustrates the die in a vacuum furnace for superplastic forming of a part.

As illustrated in FIG. 10, die 10 with preform assembly 28 therein is placed into a vacuum furnace 38, generally by use of a gantry crane or similarly heavy duty lifting equipment. Vacuum furnace 38 may be of any suitable type commonly used for superplastic forming and similar processes. Vacuum furnace 38 is then evacuated to provide a suitable vacuum and heated to a temperature at which preform assembly 28 exhibits superplasticity, which in the case of many titanium alloys is approximately 900° C. (1650° F.). Die 10 heats rapidly because it is made of graphite or similar material having good thermal conductivity. As discussed above, pins 22 and 24 preferably expand at this temperature to an extent that further secures die 10.

Inside die 10, gas fitting 36 couples to an internal gas tube 40. (See FIG. 4.) An external gas tube 42 is coupled to internal gas tube 40. A suitable gas supply and flow control system (not shown) provides pressurized gas to the interior of preform assembly 28 via tubes 42 and 40 and fitting 36. The gas is a suitable inert gas such as argon, at a suitable pressure such as 50–150 lbs/in$^2$.

The pressure exerted by the gas between sheets 30 and 32 superplastically expands them and presses them against the surfaces of interior chamber 18, including surfaces 20 and 22. Sheet 30 bears against a surface that prevents it from expanding substantially, but sheet 32 expands substantially until it is pressed into conformity with surfaces 20 and 22. Because surfaces 20 and 22 reflect the shape of the part to be formed, sheet 32 assumes the shape of the part.

Figure 11:
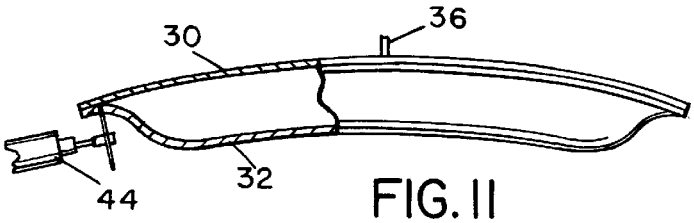
FIG. 11 is a side view of a finished part, partially in section, showing the step of trimming it.
Figure 12:
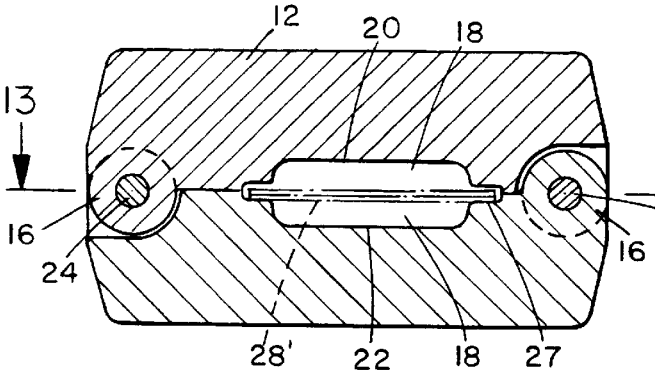
FIG. 12 is a view similar to that of FIG. 2, showing another embodiment of the invention.
Figure 13:
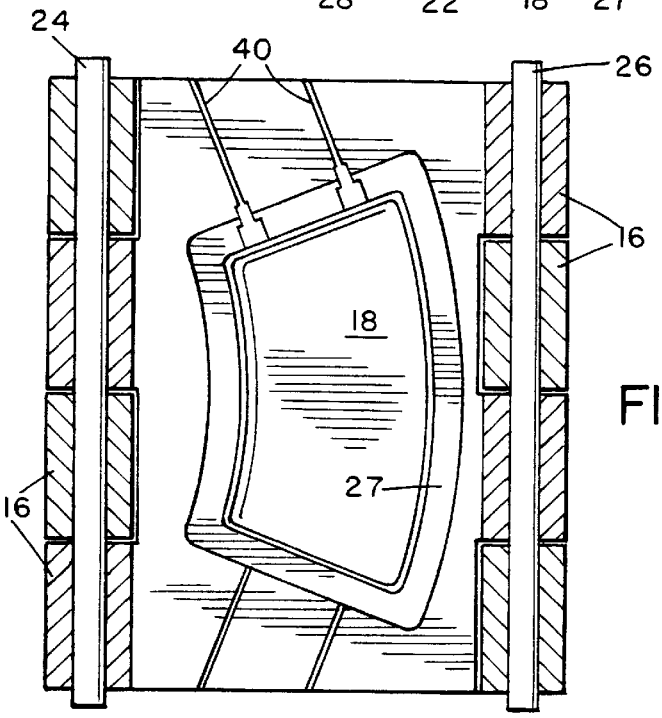
FIG. 13 is a cross-sectional view taken on Line 13—13 of FIG. 12.
Figure 15:
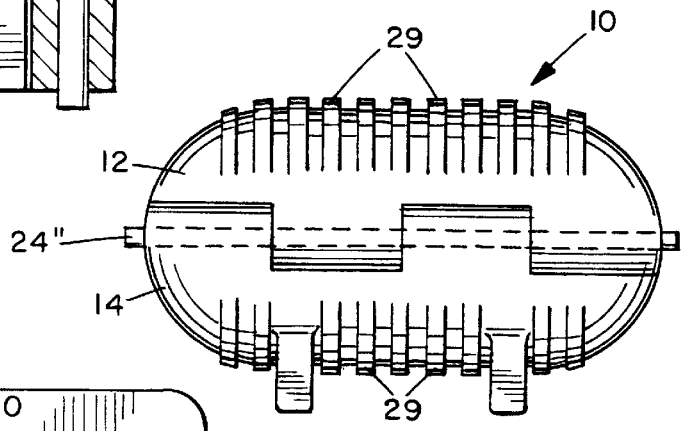
FIG. 15 is an end elevation view of yet another embodiment of the invention.

When preform assembly 28 has been suitably expanded, the gas pressure is relieved and vacuum furnace 38 is cooled. It should be noted that die 10 advantageously cools rapidly because of tool thermodynamic properties. When vacuum furnace 38 has reached a temperature suitable for handling die 10, it is opened and die 10 is removed. Die 10 is then opened by removing one or both of pins 22 and 24. That which had constituted preform assembly 28 prior to forming is removed and trimmed, as indicated in FIG. 11 by the use of tool 44, to separate the finished part from the remainder of it.

In a preferred embodiment, ribs or fins 29 can be formed on the exterior of one or both of segments 12 and 14. These ribs 29 provide stiffening and strength to the segments 12 and 14, allowing those segments to be made thinner and thus reducing the amount of material needed for the segments. In addition, and equally importantly, the ribs 29 provide for enhanced heat transfer during heating and cooling of the die 10. This, when combined with the corresponding reduction in segment mass, permits more rapid and efficient heating and cooling of the die 10 and the preform assembly 28, reducing the energy requirements of the forming operation.

As illustrated in FIGS. 5–9, in an alternative embodiment a die 46 has a generally cylindrical shape that is particularly suitable for superplastic forming (SPF) of generally cylindrical or tubular parts. Die 46 includes four generally sector-shaped die segments 48, 50, 52 and 54. Each of die segments 48–54 has connecting portions 56 unitarily formed in them. Although connecting portions 56 are interleaved in a hinge-like manner, in other embodiments they may be arranged in any suitable manner.

Figure 7:
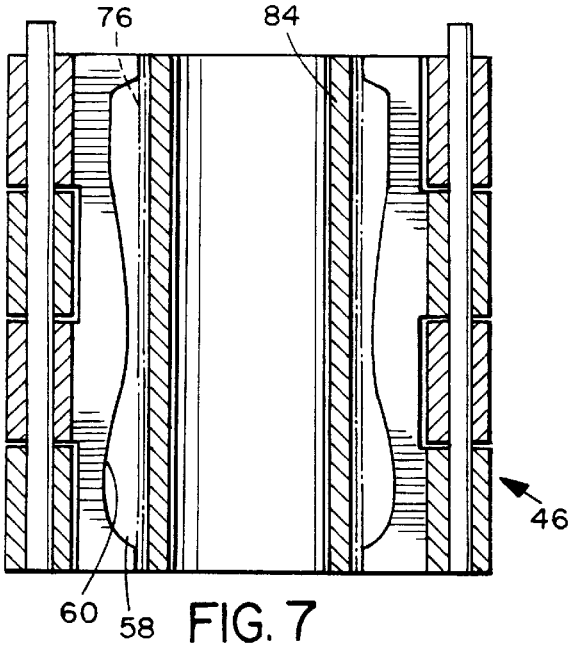
FIG. 7 is a sectional view taken on line 7—7 of FIG. 6.
Figure 9:
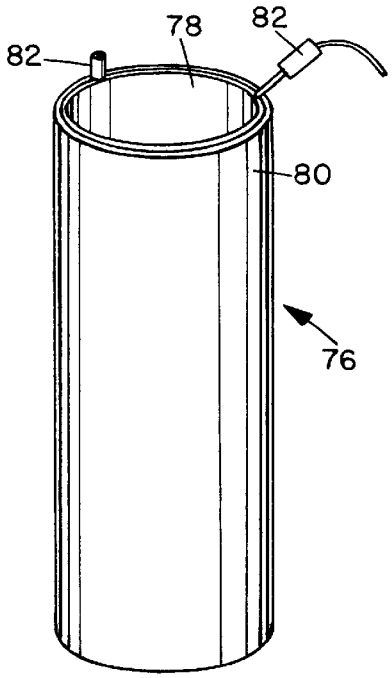
FIG. 9 illustrates the welding of the cylindrical preform assembly.

Die segments 48–54 are made of suitable material as described above with respect to the embodiment illustrated in FIGS. 1, 2, 4, 12 and 13. As illustrated in FIG. 7, die 46 has a generally cylindrical interior chamber 58 with surfaces 60, 62, 64 and 66 reflecting the shape of the part to be formed therein. The term generally cylindrical refers to the circular cross-sectional shape of die 46 at any point on its central axis. (In this example, the illustrated shape is not perfectly cylindrical but rather bottle-shaped.) Although in this exemplary die 10, the shape of the part to be formed is defined by the combined effect of surfaces 60–66 distributed among the four die segments 48–54; in other embodiments the surface or surfaces reflecting the shape of the part to be formed may be included within a single die segment or, as in the case of the embodiment described above, distributed between only two die segments. In view of these two embodiments, it should become apparent that the die of the present invention may have any number of die segments and may be of any suitable shape. Furthermore, this alternative embodiment may include ribs or fins such as ribs 29 described above with respect to the embodiment illustrated in FIGS. 1, 2, 4, 12 and 13.

Connecting portions 56 of die segments 48–54 are interlockable with one another. Four pins 68, 70, 72 and 74 are extendable through bores in connecting portions 56. Pins 68–74 are preferably made of a material and sized relative to the bores through which they extend to enable thermal expansion during the SPF process in the manner described above. As discussed above with respect to the embodiment illustrated in FIGS. 1, 2 and 4, the connecting portions may alternatively interlock directly with one another without the use of pins or other external connectors.

Figure 8:
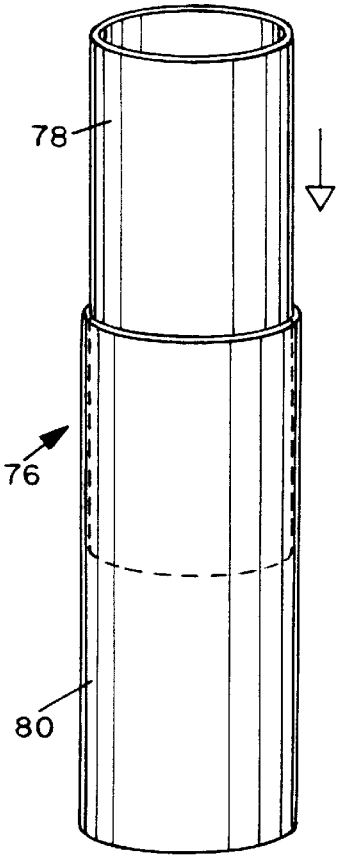
FIG. 8 illustrates the assembly of a cylindrical preform assembly.

As illustrated in FIG. 8, a preform assembly 76 suitable for use in a SPF process in conjunction with die 46 is formed by rolling two rectangular metal sheets into cylinders 78 and 80 of slightly differing diameters and placing them concentrically. Cylinders 78 and 80 are then welded together at their ends to form continuous weld beads, as indicated by the use of welding tool 82 in FIG. 9. Cylinders 78 and 80 are made of a suitable metal that exhibits superplasticity. A suitable gas fitting 82 is welded at a convenient location near one of the weld beads such that it is in communication with the space between cylinders 78 and 80. Preform assembly 76 is thus made gas-tight but for fitting 82.

Although preform assembly 76 may be disposed inside die 46 in any suitable manner, die 46 is preferably assembled around preform assembly 76. Die segments 48–54 are placed around preform assembly 76 with connecting portions 56 interleaved with one another. Pins 68–74 are then inserted through the aligned bores of connecting portions 56 to interlock die segments 48–54.

Figure 6:
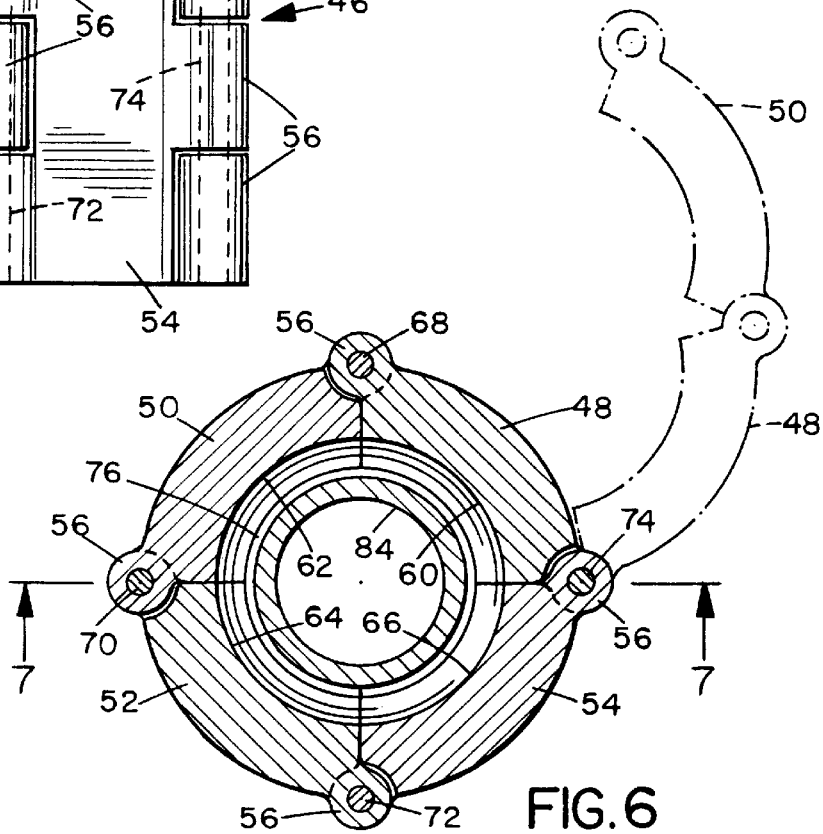
FIG. 6 is a sectional view taken on line 6—6 of FIG. 5.

As illustrated in FIGS. 6 and 7, a cylindrical mandrel 84 is placed inside preform assembly 76. Mandrel 84 is preferably made of steel or Inconel.

As described above with respect to other embodiments, die assembly 46 with preform assembly 76 therein is placed into vacuum furnace 38. (See FIG. 10.) Vacuum furnace 38 is then evacuated and heated to a temperature at which preform assembly 28 exhibits superplasticity.

An external gas tube, such as gas tube 42, is coupled to gas fitting 82. Pressurized gas is introduced into the interior of preform assembly 76. The pressure exerted by the gas between cylinders 78 and 80 superplastically expands them. Cylinder 78 bears against mandrel 84, which prevents it from expanding substantially, but cylinder 80 expands substantially until it is pressed into conformity with surfaces 60–66. Because the combined effect of surfaces 60–66 is to reflect the shape of the part to be formed, cylinder 80 assumes the shape of the part or a portion thereof.

When preform assembly 76 has been suitably expanded, the gas pressure is relieved and vacuum furnace 38 is cooled. When vacuum furnace 38 has reached a temperature suitable for handling die 46, it is opened and die 46 is removed. Die 46 is then opened by removing one or more of pins 68–74. That which had constituted preform assembly 76 prior to forming is removed and trimmed, as described above with respect to other embodiments, to separate the finished part from the remainder of it.

Other embodiments and modifications of the present invention will occur readily to those of ordinary skill in the art in view of these teachings. For example, it should be noted that the die may have any number of two or more die segments. The die may open in a hinged manner or it may be disassembled entirely. Furthermore, it should be noted that the generally planar and generally cylindrical dies described above are merely exemplary embodiments of a die invention that encompasses configurations ranging from planar to cylindrical, including the entire spectrum of configurations therebetween. Therefore, this invention is to be limited only by the following claims, which include all such other embodiments and modifications when viewed in conjunction with the above specification and accompanying drawings.

What is claimed is:

1. A die apparatus for forming a part, comprising:

a plurality of die segments, each die segment unitarily formed from a material selected from the group consisting of graphite and ceramic, each die segment having a unitarily formed connecting portion for interlocking said die segment to another of said die segments; and said connecting portion of each die segment interlockable with a connecting portion of another one of said die segments to define a die having an interior chamber with a surface reflecting a shape of said part.

2. The die apparatus recited in claim 1, wherein said connecting portion of at least one said die segment is removably interlockable with a connecting portion of another one of said die segments.

3. The die apparatus recited in claim 1, wherein said connecting portion of at least one said die segment is hingedly interlockable with a connecting portion of another one of said die segments, said die openable to expose said interior chamber by swinging said hingedly interlockable die segments with respect to one another.

4. The die apparatus recited in claim 1, wherein:

each said connector comprises a bore; and said die apparatus further comprises a plurality of pins extendable through said bores to interlock said die segments.

5. The die apparatus recited in claim 4, wherein:

each said bore has a bore diameter; and each said pin has a pin diameter less than said bore diameter at a temperature less than about 100° C. and equal to said bore diameter at a temperature greater than about 500° C.

6. The die apparatus recited in claim 1, wherein a cross section of said chamber is circular.

7. The die apparatus recited in claim 1, wherein said die is generally cylindrical, and said die segments are generally sector-shaped.

8. The die apparatus recited in claim 1 comprising two said die segments.

9. The die apparatus recited in claim 1 comprising at least three said die segments.

10. The die apparatus recited in claim 1 comprising a plurality of ribs formed on the exterior surfaces of at least one of said die segments.

11. A die apparatus for forming a part, comprising:

a plurality of generally sector-shaped die segments, each die segment unitarily formed from a material selected from the group consisting of graphite and ceramic, each die segment having a bore; and a plurality of pins extendable through said bores for interlocking said die segments to one another to define a generally cylindrical die having an interior chamber with a surface reflecting a shape of said part.

12. The die apparatus recited in claim 11, wherein:

said die has a longitudinal axis; and said bore of each die segment is axially aligned with a bore of another said die segment when said die segments are interlocked.

13. A die apparatus for forming a part, comprising:

a plurality of die segments, each die segment unitarily formed from a material selected from the group consisting of graphite and ceramic, each die segment having a unitarily formed connector; and a first group of die segments defining a first die portion, and a second group of die segments defining a second die portion, said first and second die portions hingedly connected to one another and hingedly swingable between a closed position in which said first and second die portions together enclose an interior chamber having a surface reflecting a shape of said part and an open position in which said interior chamber is exposed.

14. The die apparatus recited in claim 13, wherein each of said first and second groups of die segments consists of a single die segment.

15. The die apparatus recited in claim 14, wherein said die segment of said first group and said die segment of said second group each has a bore, and said die apparatus includes a hinge pin extending through said bore of each said die segment.

16. A superplastic forming method for forming a part, comprising the steps of:

providing a die comprising a plurality of die segments having unitarily formed connecting portions for interlocking said die segments to one another, said die having an interior chamber with a surface reflecting a shape of said part;

providing a gas-tight metal preform assembly having a gas fitting;

disposing said preform assembly in said interior chamber;

interlocking said die segments;

heating said die in which said preform assembly is disposed; and injecting gas into said gas fitting of said preform assembly until said preform assembly expands against said surface of said interior chamber.

17. The method recited in claim 16, wherein said step of providing a gas-tight metal preform assembly comprises the steps of:

providing first and second planar metal sheets each having a periphery;

disposing said first and second planar metal sheets in a co-planar orientation, with said periphery of said first planar metal sheet aligned with said periphery of said second planar metal sheet;

disposing a gas fitting at a position on at least one of said first and second planar metal sheets; and welding said first metal sheet to said second metal sheet to form a continuous weld bead along their peripheries that is gas-tight but for said gas fitting.

18. The method recited in claim 16, further comprising the step of disposing a mandrel in said interior chamber, wherein said disposing said preform assembly in said interior chamber comprises disposing said preform assembly between said surface and said mandrel.

19. The method recited in claim 16, wherein:

said step of providing a die comprises providing a die in which said connecting portions include bores; and said step of interlocking said die segments comprises extending pins through said bores of a plurality of die segments.

20. The method recited in claim 19, wherein:

each said bore has a bore diameter; and said step of heating said die in which said preform assembly is disposed comprises heating until each said pin expands to a pin diameter greater than or equal to said bore diameter.

21. The method recited in claim 16, wherein:

said step of providing a die comprises providing a die in which a first group of die segments define a first die portion, and a second group of die segments define a second die portion, and said first and second die portions are hingedly connected to one another and hingedly swingable between a closed position and an open or separable position; and said step of interlocking said die segments comprises swinging said first and second die portions to said closed position and interlocking said first and second die portions in said closed position.

22. A superplastic forming method for forming a part, comprising the steps of:

providing a die having first and second die portions hingedly connected to one another and hingedly swingable between a closed position and an open position, said die having an interior chamber with a surface reflecting a shape of said part;

providing a gas-tight planar metal preform assembly having a gas fitting;

swinging said first and second die portions relative to one another to said open position;

disposing said preform assembly in said interior chamber;

swinging said first and second die portions relative to one another to said closed position;

heating said die in which said preform assembly is disposed; and injecting gas into said gas fitting of said preform assembly until said preform assembly expands against said surface of said interior chamber.

* * * * *